US008805682B2

(12) United States Patent
Weinblatt

(10) Patent No.: US 8,805,682 B2
(45) Date of Patent: Aug. 12, 2014

(54) REAL-TIME ENCODING TECHNIQUE

(76) Inventor: Lee S. Weinblatt, Teaneck, NJ (US)

( * ) Notice: Subject to any disclaimer, the term of this patent is extended or adjusted under 35 U.S.C. 154(b) by 239 days.

(21) Appl. No.: 13/188,397

(22) Filed: Jul. 21, 2011

(65) Prior Publication Data

US 2013/0024188 A1 Jan. 24, 2013

(51) Int. Cl.
*G10L 21/02* (2013.01)

(52) U.S. Cl.
USPC ..... 704/227; 704/205

(58) Field of Classification Search
None
See application file for complete search history.

(56) References Cited

U.S. PATENT DOCUMENTS 4,688,255 A * 8/1987 Kahn ..... 381/16
5,228,093 A * 7/1993 Agnello ..... 381/119
5,450,490 A * 9/1995 Jensen et al. ..... 380/253
5,844,158 A * 12/1998 Butler et al. ..... 84/650
6,467,089 B1 * 10/2002 Aust et al. ..... 725/13
7,660,991 B2 * 2/2010 Nakamura et al. ..... 713/176
7,974,422 B1 * 7/2011 Ho et al. ..... 381/119
8,032,378 B2 * 10/2011 Stephens, Jr. ..... 704/260
8,126,029 B2 * 2/2012 Elias ..... 375/140
8,185,100 B2 * 5/2012 Jones et al. ..... 455/420
8,199,791 B2 * 6/2012 Elias ..... 375/140
8,488,805 B1 * 7/2013 Santos et al. ..... 381/77
2002/0044659 A1 * 4/2002 Ohta ..... 380/241
2003/0028380 A1 * 2/2003 Freeland et al. ..... 704/260
2003/0054757 A1 * 3/2003 Kolessar et al. ..... 455/2.01
2004/0102975 A1 * 5/2004 Eide ..... 704/258
2005/0190899 A1 * 9/2005 Rhodes ..... 379/101.01

* cited by examiner

*Primary Examiner* — Brian Albertalli
(74) *Attorney, Agent, or Firm* — Cozen O'Connor

(57) ABSTRACT

A system for encoding an audio signal includes an audio console configured to receive a voice audio signal contained within a first audio spectrum, encode the voice audio signal with a background audio signal contained within a second audio spectrum wider than the first audio spectrum, encode the voice audio signal with a monitoring code and output a combined signal including the voice audio signal encoded with the background audio signal and the monitoring code. The combined signal is contained within an audio spectrum including the first audio spectrum and the second audio spectrum.

15 Claims, 2 Drawing Sheets

REAL-TIME ENCODING TECHNIQUE

FIELD OF THE INVENTION

The present invention is related to a technique for encoding a signal to enable audience monitoring. In particular, example embodiments are directed to a system and method that encode a voice audio signal with a background audio signal and a monitoring code in real-time.

BACKGROUND OF THE INVENTION

Various techniques are known for monitoring transmissions from signal sources such as a television station, a radio station, satellite and cable television providers (referred to collectively hereinafter as "broadcast source"). The signal of interest might be a program being transmitted by cable or satellite, or it might be a recorded program being played back from a CD, DVD or VCR. The program may be a "show" providing musical or dramatic entertainment, or it might be a commercial. The monitoring is carried out to provide information that, for example, reveals the size of the audience tuned to a given broadcast source at a given time of day, determines the total number of people who have heard or seen a program, provides independent validation that a commercial has been broadcast, and so on. Such information is useful for broadcasters, advertisers, etc. As used hereinafter, the term "program signal" is intended to include all such signals, be they, for example, a real time broadcast or one that has been recorded, to be suitably reproduced to be electronically performed for listening or viewing by an audience of a show or a commercial about which such information is being collected.

One approach that has been adopted to perform such monitoring is to combine the audio portion of a program signal with a code signal at the broadcasting end. The combined signal is made available, such as by on-air broadcast, to an intended audience. A receiver at the audience end detects the combined signal, uses the program signal to perform the program, and uses the code signal for audience monitoring. This is disclosed, for example, in U.S. Pat. Nos. 4,718,106, 5,457,807 and 5,630,203.

An audio signal for voice audio from a radio program is contained within a relatively narrow frequency spectrum. AM talk radio has a particularly narrow spectrum. The voice audio signal is vulnerable to extraneous and disturbing sounds if it is encoded with a monitoring code. Normal gaps that occur during speech are particularly vulnerable to encoding anomalies resulting from encoding the voice audio signal with the monitoring code. For example, by encoding the voice audio signal with the monitoring code, an instance of the monitoring code that occurs during a normal gap in speech in the voice audio signal may cause a listening audience to experience an extraneous and disturbing sound.

Many radio commercials contain only voice audio, and these voice audio commercials are often broadcast in real-time. Furthermore, voice audio commercials are constantly changed, and there is often no time to encode the voice audio with the monitoring code.

SUMMARY OF THE INVENTION

According to one aspect of the invention, a system for encoding an audio signal comprises an audio console. The audio console is configured to receive a voice audio signal contained within a first audio spectrum, encode the voice audio signal with a background audio signal contained within a second audio spectrum wider than the first audio spectrum, encode the voice audio signal with a monitoring code and output a combined signal including the voice audio signal encoded with the background audio signal and the monitoring code. The combined signal is contained within an audio spectrum including the first audio spectrum and the second audio spectrum.

According to another aspect of the invention, a method for encoding an audio signal comprises receiving a voice audio signal contained within a first audio spectrum, encoding the voice audio signal with a background audio signal contained within a second audio spectrum wider than the first audio spectrum, encoding the voice audio signal with a monitoring code, and outputting a combined signal including the voice audio signal encoded with the background audio signal and the monitoring code. The combined signal is contained within an audio spectrum including the first audio spectrum and the second audio spectrum.

According to still another aspect of the invention, a computer readable medium stories a computer program which when executed by a computer performs a method comprising receiving a voice audio signal contained within a first audio spectrum, encoding the voice audio signal with a background audio signal contained within a second audio spectrum wider than the first audio spectrum, encoding the voice audio signal with a monitoring code, and outputting a combined signal including the voice audio signal encoded with the background audio signal and the monitoring code. The combined signal is contained within an audio spectrum including the first audio spectrum and the second audio spectrum.

BRIEF DESCRIPTION OF THE DRAWINGS

The above and/or other aspects and advantages will become more apparent and more readily appreciated from the following detailed description of embodiments of the invention taken in conjunction with the accompanying drawings of which.

DETAILED DESCRIPTION OF THE DRAWINGS

Figure 1:
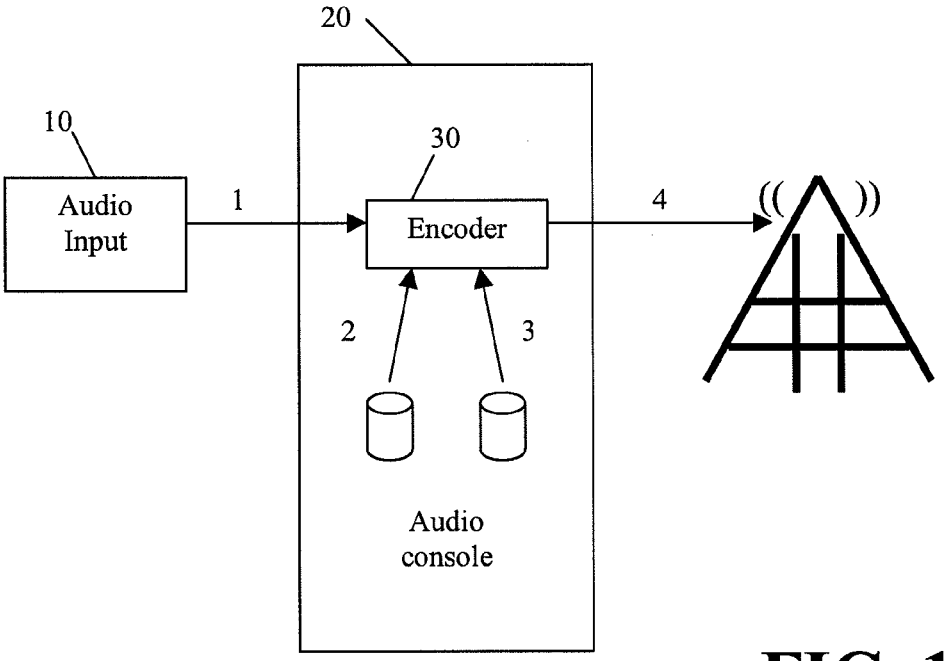
FIG. 1 is a schematic block diagram showing a system for real-time encoding of an audio signal according to an embodiment of the invention.

As shown in FIG. 1, a system for real-time encoding includes an audio input 10 and an audio console 20. The audio input 10 provides voice audio signal 1 to the audio console 20 from an audio source. The audio input 10 may be a microphone configured to receive voice input as an audio source and/or any digital or analog media player configured to provide an output signal to the audio console 20 from an audio source. For example, the audio input 10 may be a radio DJ's microphone at a radio station configured to provide an output signal for broadcasting the radio DJ's voice over-the-air, the Internet or another known medium. Alternatively, or additionally, the audio input 10 may be a media player configured to produce an output signal for broadcast over-the-air, the Internet or another known medium from digital media stored on a recording medium, e.g., CD, DVD or memory, or from analog media stored on an analog recording medium, e.g., a vinyl record, etc.

At least a portion of the voice audio signal 1 output from the audio input 10 comprises only speech or other audio that is contained within a relatively narrow audio spectrum. The voice audio signal 1 may be output in real-time from the audio input 10, for example, as corresponding speech or another audio source received by the microphone and/or as corresponding media is played back by the media player. For example, the voice audio signal 1 may comprise a commercial that includes speech from the radio DJ reading an advertisement bulletin over the air in real-time into the microphone.

Figure 2:
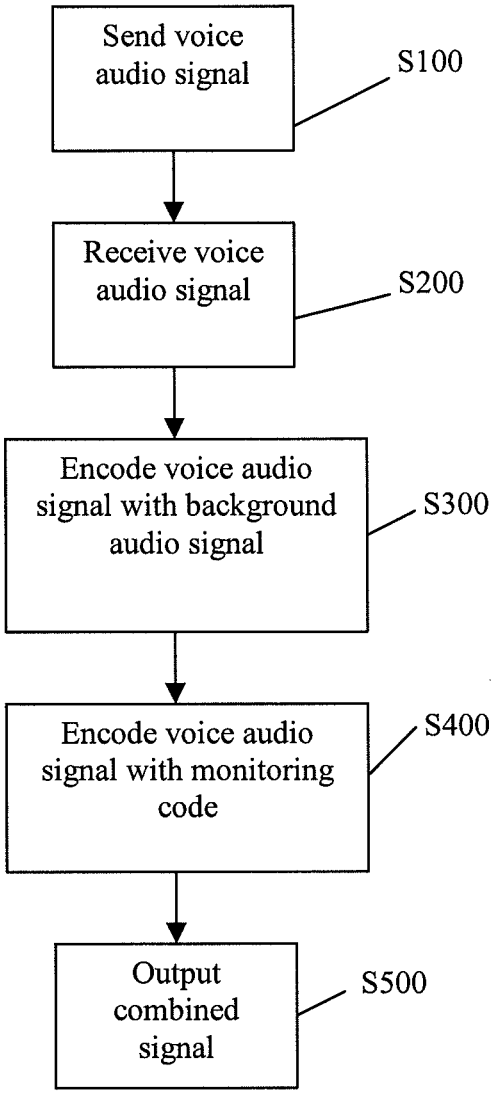
FIG. 2 is a flow chart showing a method for real-time encoding of an audio signal according to an embodiment of the invention.

The audio input 10 sends the voice audio signal 1 to the audio console 20 (see step S100 in FIG. 2). The audio input 10 may send the voice audio signal 1 to the audio console 20 in real-time as it is received and/or produced by the audio input 10 from an audio source. The audio console 20 comprises an encoder 30 configured to encode audio signals. The audio console 20 receives the voice audio signal 1 and encodes the voice audio signal 1 with a background audio signal 2 (steps S200 and S300). That is, the encoder 30 of the audio console 20 combines the voice audio signal 1 with the background audio signal 2, for example, with a musical background (step S300).

The background audio signal 2 is contained within a wider and/or different audio spectrum, e.g., a wider and/or different frequency spectrum, than the voice audio signal 1 received from the audio input 10. The background audio signal 2 is a continuous audio source such that it fills normal gaps that occur during speech in the voice audio signal 1. The combination of the voice audio signal 1 and the background audio signal 2 provides a wider spectrum in the form of the combined audio signal which reduces the effect from extraneous and disturbing sounds resulting from encoding the voice audio signal 1 with the monitoring code 3. Normal gaps that occur during speech and which are particularly vulnerable to encoding anomalies are filled by the background audio from the background audio signal 2 which acts to minimize the effects of disturbing sounds. The background audio 2 thus spreads the otherwise narrow voice audio spectrum of the voice audio signal 1.

The encoder 30 of the audio console 20 encodes the voice audio signal 1 with a monitoring code 3 (step S400). Although FIGS. 1 and 2 show that the monitoring code 3 is combined with the voice audio signal 1 after the voice audio signal 1 has been encoded with the background audio signal 2, the invention is not limited thereto, and the audio console 20 can just as well encode the voice audio signal 1 with the monitoring code 3 before encoding the voice audio signal 1 with the background audio signal 2. Regardless of the order in which the voice audio signal 1, the background audio signal 2 and the monitoring code 3 are combined, the combination of the voice audio signal 1 and the background audio signal 2 provides a wider spectrum in the form of a combined audio signal 4 (see step S500) which reduces the effect from extraneous and disturbing sounds resulting from encoding the voice audio signal 1 with the monitoring code 3.

The audio console 20 encodes the voice audio signal 1 received from the audio input 10 in real-time. As the voice audio signal 1 is received at the audio console 20, the audio console 20 encodes the voice audio signal 1 with the background audio signal 2 and the monitoring code 3 in real-time. For example, if a DJ is performing a live broadcast using a microphone as the audio input 10, the audio console 20 encodes the audio signal 1 from the microphone with the background audio signal 2 and the monitoring code 3 as it is produced from the speech of the DJ input into the microphone and sent by the audio input 10. Accordingly, a live broadcast may be created by the audio console 20 for transmission over-the-air, the Internet or other transmission medium or network.

According to an alternative example embodiment, the audio console 20 stores a plurality of different background audio signals. The plurality of different background audio signals may be stored in the audio console 20 or in an external database connected to the audio console 20. The different background audio signals are appropriate for encoding different messages contained in the voice audio signal 1. The audio console 20 may store a plurality of different monitoring codes. The plurality of different monitoring codes may be stored in the audio console 20 or in an external database connected to the audio console 20. Accordingly, the different monitoring codes may be used to identify different programs and messages and monitor the audiences thereof.

Either the user or the audio console 20 selects one of the plurality of different background audio signals to be combined with the voice audio signal 1 sent from the audio input 10. For example, the DJ may select a particular background audio signal that is suitable for the commercial corresponding to the speech in the audio signal being transmitted over-the-air. A default background audio signal may be used for encoding the voice audio signal 1 by the audio console 20 if the user does not select a particular one of the plurality of different background audio signals. Alternatively, the audio console 20 may be configured to select a background audio signal from among the plurality of different background audio signals that is suitable for the commercial based on information included with the voice audio signal 1 received from the audio input 10. For example, the voice audio signal 1 may include an ID tag or other information identifying a particular background audio signal from among the plurality of background audio signals stored by the audio console 20. The audio console 20 encodes the voice audio signal 1 with the selected or default background audio signal. Accordingly, background audio that is suitable for the speech of the voice audio signal 1 with which it is being combined may be used to encode the voice audio signal 1. As with the different background audio signals, one of the different monitoring codes may be selected by either the user or the audio console 20 to be combined with the voice and audio signal 1. Accordingly, a monitoring code that indentified the voice audio signal 1 with which it is being combined maybe used to encode the voice audio signal 1 and monitor the audience thereof.

The audio console 20 sends the combined audio signal 4, which includes the voice audio signal 1 encoded with the background audio signal 2 and the monitoring code 3 to a broadcast transmission center, over the Internet or over another network configured to deliver the combined audio signal 4 to listener devices in the form of a program signal configured to be suitably reproduced to be electronically performed for listening by an audience of a show or a commercial (see step S500).

Although example embodiments have been shown and described in this specification and figures, it would be appreciated by those skilled in the art that changes may be made to the illustrated and/or described example embodiments without departing from their principles and spirit.

What is claimed is:

1. A system for encoding an audio signal, the system comprising:

an audio console configured to receive a voice audio signal contained within a first audio spectrum, encode the voice audio signal with a background audio signal contained within a second audio spectrum wider than the first audio spectrum, encode the voice audio signal with a monitoring code and output a combined signal including the voice audio signal encoded with the background audio signal and the monitoring code, wherein the combined signal is contained within an audio spectrum including the first audio spectrum and the second audio spectrum.

2. The system according to claim 1, further comprising:

an audio input configured to produce the voice audio signal from an audio source and send the voice audio signal to the audio console.

3. The system according to claim 2, wherein the audio input produces and sends the voice audio signal to the audio console in real-time.

4. The system according to claim 1, wherein at least a portion of the voice audio signal contains only speech when reproduced.

5. The system according to claim 1, wherein the audio console is configured to store a plurality of different background audio signals, and the background audio signal used to encode the voice audio signal is selected from among the plurality of different background audio signals based on at least one of a user input and information included in the voice audio signal.

6. The system according to claim 1, wherein the background audio signal is continuous audio when reproduced.

7. The system according to claim 1, wherein the audio console is configured to encode the audio signal with the background audio signal and the monitoring code in real-time as the audio signal is received at the audio console.

8. A method for encoding an audio signal, the method comprising:

receiving a voice audio signal contained within a first audio spectrum;

encoding the voice audio signal with a background audio signal contained within a second audio spectrum wider than the first audio spectrum;

encoding the voice audio signal with a monitoring code; and outputting a combined signal including the voice audio signal encoded with the background audio signal and the monitoring code, wherein the combined signal is contained within an audio spectrum including the first audio spectrum and the second audio spectrum.

9. The method according to claim 8, further comprising:

producing the voice audio signal from an audio source.

10. The method according to claim 9, wherein the voice audio signal is produced and received in real-time.

11. The method according to claim 8, wherein at least a portion of the voice audio signal contains only speech when reproduced.

12. The method according to claim 8, comprising storing a plurality of different background audio signals, and selecting the background audio signal used to encode the voice audio signal from among the plurality of different background audio signals based on at least one of a user input and information included in the voice audio signal.

13. The method according to claim 8, wherein the background audio signal is continuous audio when reproduced.

14. The method according to claim 8, wherein the audio signal is encoded with the background audio signal and the monitoring code in real-time as the audio signal is received.

15. A computer readable non-transitory medium storing a computer program which when executed by a computer performs a method comprising:

receiving a voice audio signal contained within a first audio spectrum;

encoding the voice audio signal with a background audio signal contained within a second audio spectrum wider than the first audio spectrum;

encoding the voice audio signal with a monitoring code; and outputting a combined signal including the voice audio signal encoded with the background audio signal and the monitoring code, the combined signal contained within an audio spectrum including the first audio spectrum and the second audio spectrum.

* * * * *